US009463368B2

(12) United States Patent
Garnier

(10) Patent No.: US 9,463,368 B2
(45) Date of Patent: Oct. 11, 2016

(54) DEVICE FOR MANAGING THE ILLUMINATION OF THE GRIPS OF A CLIMBING WALL

(71) Applicant: X'SIN, Savigny (FR)

(72) Inventor: Denis Garnier, Blace (FR)

(73) Assignee: X'SIN, Savigny (FR)

( * ) Notice: Subject to any disclaimer, the term of this patent is extended or adjusted under 35 U.S.C. 154(b) by 0 days.

(21) Appl. No.: 14/896,455

(22) PCT Filed: Jun. 6, 2014

(86) PCT No.: PCT/FR2014/051360
§ 371 (c)(1),
(2) Date: Dec. 7, 2015

(87) PCT Pub. No.: WO2014/195651
PCT Pub. Date: Dec. 11, 2014

(65) Prior Publication Data

US 2016/0136496 A1 May 19, 2016

(30) Foreign Application Priority Data

Jun. 6, 2013 (FR) ..... 13 55197

(51) Int. Cl.

| | |
|---|---|
| ***A63B 22/00*** | (2006.01) |
| ***A63B 69/00*** | (2006.01) |
| ***A63B 71/06*** | (2006.01) |
| ***H05B 37/02*** | (2006.01) |

(52) U.S. Cl.
CPC ..... *A63B 69/0048* (2013.01); *A63B 71/0605* (2013.01); *H05B 37/029* (2013.01); *H05B 37/0272* (2013.01); *A63B 2071/0694* (2013.01); *A63B 2207/02* (2013.01); *A63B 2220/833* (2013.01); *A63B 2225/50* (2013.01); *A63B 2225/54* (2013.01)

(58) Field of Classification Search
USPC ..... 482/8, 51–52, 37
See application file for complete search history.

(56) References Cited

U.S. PATENT DOCUMENTS

2010/0004098 A1* 1/2010 Hensley ..... A63B 69/0048 482/37

FOREIGN PATENT DOCUMENTS

| | | |
|---|---|---|
| WO | 2005/049155 A1 | 6/2005 |
| WO | 2012/076825 A1 | 6/2012 |

OTHER PUBLICATIONS

International Search Report dated Oct. 28, 2014 from corresponding International Application No. PCT/FR2014/051360; 3 pgs.

* cited by examiner

*Primary Examiner* — Minh D A
(74) *Attorney, Agent, or Firm* — Maier & Maier, PLLC

(57) ABSTRACT

An illumination management device intended for an artificial climbing wall having at least one emission loop arranged so as to be fixed to the rear of the wall and able to emit an electromagnetic field through the wall, at least one luminous grip arranged so as to be fixed to the front of the wall and being able to receive an electronic card includes at least one light source and a reception loop able to receive said electromagnetic field emitted by the associated emission loop so as to convert it into electric current in order to power the light source, and a control housing for the light source being arranged so as to be connected to an electrical network so as to power the emission loop with electric current and able to send commands to manage the illumination of the light source.

13 Claims, 4 Drawing Sheets

DEVICE FOR MANAGING THE ILLUMINATION OF THE GRIPS OF A CLIMBING WALL

TECHNICAL FIELD

This invention relates to a device for managing the illumination of a climbing wall in order to primarily dynamically mark courses, called paths, to be carried out by the users, said paths being predefined by the manager of said wall according to the desired difficulty and/or the level of the user, said device for managing also making it possible to make use of the associated animation capacities.

PRIOR ART

Climbers have always sought to rank the climbing paths in degrees of difficulty. When artificial walls appeared, courses were plotted by positioning coloured grips, each course with different colours representing an itinerary with its own degree of difficulty. However, the multiple overlappings of courses and the grips of all colours render the readability of the plots difficult for the least.

In this respect, grips provided with lights intended to be mounted on a climbing wall using usual means of fastening are already known. The latter are comprised of a body comprising an outer portion intended to support a climber and a substantially planar mounting face able to cooperate with said climbing wall. The body advantageously comprises an inner compartment made from a transparent or translucent construction material able to allow light to pass through. Said lighted climbing grips also comprising one or several sources of light arranged inside the body or inner compartment, or in the vicinity of said grips or flush with the surface of the latter, with said sources of light being connected to a source of energy thanks to power supply cables arranged behind the climbing wall and passing through said wall thanks to orifices. However, this type of lighted grips is not compatible with a renewing of the climbing wall consisting in a modification of the position of said grips either by changing their geographical position on the wall, or by rotating said grips about their axis. Indeed, if the position of the lighted grips changes, it may be necessary to extend the electric power supply cables and make new orifices for passing through said climbing wall. These operations are tedious and expensive because it is not always easy to access the rear of the climbing wall, once the latter is installed. Likewise, it is necessary to mount/dismount the grips frequently in order to clean them. These operations are then delicate because the grips must be connected/disconnected from the electric power supply cables every time. Finally, the multiplication of orifices can in the long run weaken the climbing wall.

In order to overcome a portion of these disadvantages, autonomous lighted grips provided with batteries are known. However, this type of lighted grips still has several disadvantages. Indeed, on the one hand, these batteries have a limited lifespan which requires relatively frequent replacing and which requires creating in the grip itself a substantial housing for installing them which as such limits their use in grips of significant dimensions and, on the other hand, recycling batteries still remains a delicate environmental problem.

DISCLOSURE OF THE INVENTION

The purpose of this invention is therefore to overcome the aforementioned disadvantages and to propose a device for illuminating a climbing wall that is easy to install, autonomous and that makes it possible to easily change the courses of said climbing wall, at least cost and without complex and expensive operations, said device able to be installed on most of the existing climbing walls.

In accordance with the invention, a device for managing illumination is therefore proposed intended for an artificial climbing wall remarkable in that it comprises at least one emission loop arranged so as to be fixed to the rear of the wall and being able to emit an electromagnetic field through said wall, at least one lighted grip arranged to be fastened to the front of said wall and able to receive an electronic card comprising at least one light source and a reception loop able to receive said electromagnetic field emitted by the associated emission loop so as to convert it into electric current in order to power said light source, and a control housing of the light source being arranged so as to be connected to an electrical network in order to supply said emission loop with electric current and able to send commands in order to manage the illumination of said light source.

The electronic card advantageously comprises a presence detector for a climber on the associated grip, the presence detector being preferably a reed switch associated with a magnet or an RFID reader associated with a tag, the magnet or the tag having the form of a bracelet arranged to be worn by a climber.

The electronic card also comprises a regulator and a microcontroller making possible in particular the management of the identification information of the light source and of the associated grip.

Advantageously, the electronic card is embedded in the material of the grip.

More advantageously, the electronic card is embedded in the material of an independent removable subset able to be inserted into the back of the grip.

The grip or the subset comprises a portion made of flexible material to receive the electronic card.

The control housing comprises an electrical power supply in order to supply said emission loop with electric current and a microcontroller making it possible to control the proper operation of the device for managing the illumination.

Advantageously, the device for managing the illumination comprises a multi-platform software interface.

For this, the software interface is more preferably carried out in the form of a web server built into said control housing of the light sources.

According to a preferred embodiment, the device for managing the illumination comprises at least one interactive terminal making it possible to manage the illumination of one or several paths and the control housing comprises a means of connection allowing the terminal to be connected to the software interface built into said housing via a wireless protocol or via cables.

According to an even more advantageous embodiment, the device for managing the illumination comprises a bidirectional link between the grip or grips and the control housing of the light sources making it possible to measure and record the time taken by a climber to carry out the chosen path.

The bidirectional link more preferably uses radiofrequencies and the electronic card of the grip and the control housing of the light sources each comprise a transceiver.

BRIEF DESCRIPTION OF THE FIGURES

Other advantages and characteristics shall appear more clearly in the following description of an embodiment of a device for managing the illumination of a climbing wall according to the invention in reference to the annexed figures wherein.

BEST METHOD OF CARRYING OUT THE TECHNICAL INVENTION

Figure 1:
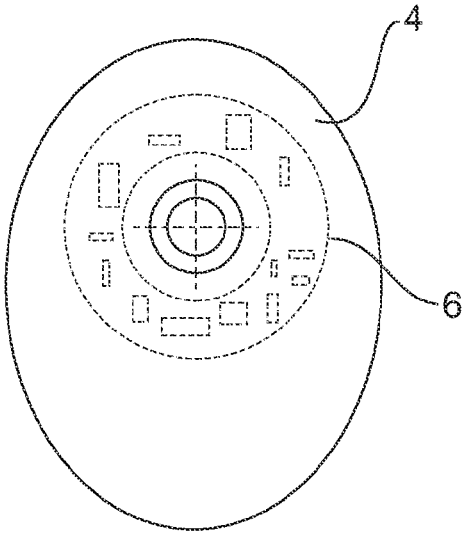
FIG. 1 is a front view of a grip of a device for managing the illumination of a climbing wall according to the invention.
Figure 2:
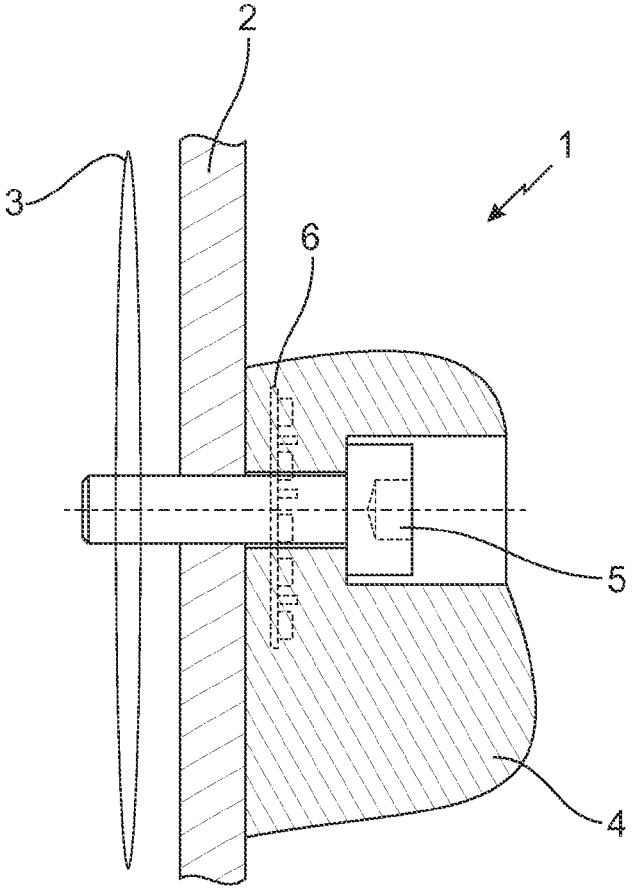
FIG. 2 is a vertical section of the grip of FIG. 1 fastened onto a climbing wall.

In reference to FIGS. 1 and 2, the device for managing 1 the illumination of a climbing wall 2 comprises at least one emission loop 3 arranged so as to be fixed to the rear of the wall 2, connected to an electrical network and being able to emit an electromagnetic field through said wall 2, and a lighted grip 4 arranged to be fastened to the front of said wall 2 thanks to means of fastening 5 of the bolt or screw type for example, said grip 4 able to receive an electronic card 6 comprising at least one light source and a reception loop 8 able to receive said electromagnetic field emitted by the associated emission loop 3 and convert it into electric current in order to power said light source 7.

"Front" of the climbing wall 2 here designates the face that is opposite the climber when the latter is about to climb said wall 2, and "rear" the opposite face.

Due to the frequent removal/reinstalling of the grips 4 in order to clean them in particular, the use of a power supply via magnetic induction is particularly adapted to overcome the disadvantages of wired electrical power supply systems.

Those skilled in the art will have no difficulty in determining the characteristics of the power supply via magnetic induction to be implemented according in particular to the nature and the thickness of the wall 2.

For the same reasons, the electronic card 6 is more preferably embedded in the resin of the grip 4 in order to render the whole sealed and robust, said resin being conventionally of the orthophthalic polyester or polyurethane or epoxy type, for example, and becoming hard after moulding.

However, whereas the grips made of hard resin do not make it possible to recover the electronic card 6 at the end of its life in order to be recycled, the electronic card 6 can be embedded in a portion of the grip 4 made of "flexible" material, such as silicone for example, with the flexible portion then being itself embedded in a harder resin. This alternative embodiment not shown would make it possible to facilitate the extraction of the electronic card 6, and therefore to consider the recycling of the latter.

According to an alternative embodiment not shown, the electronic card 6 is embedded in an independent removable subset which will be inserted into the back of the grip 4, with the latter comprising a reservation able to receive said subset. Moreover, as hereinabove, in order to facilitate the extraction of the electronic card 6, the latter can also be embedded in a portion of the subset made of "flexible" material, such as silicone for example, with the flexible portion then itself being embedded in a harder resin.

Those skilled in the art will have no difficulty in determining the number and the type of electronic components of the electronic card 6, so that the latter provide the correct operation of the grip 4 and are compatible with the chemical, thermal and mechanical constraints linked to integration in said grip 4.

However, in order to limit the effects of the chemical and thermal constraints, the electronic card 6 can, prior to being immersed in the grip 4 or in the subset, be cast in a protective resin. This resin can also soften any mechanical constraints during the solidification of the resin of the grips 4.

The light source 7 is advantageously a LED (Light Emitting Diode) able to emit light of several different colours according to the needs and paths to be marked. Using a LED also makes it possible to easily adjust the intensity of the light flow in order to adapt the device for managing 1 to the ambient lighting conditions.

As the atmosphere in the vicinity of the wall 2 is loaded with magnesia powder, each grip 4 is as such easy to remove, allowing for frequent cleaning in order to ensure the reliability and the sustainability of said device for managing 1.

Figure 3:
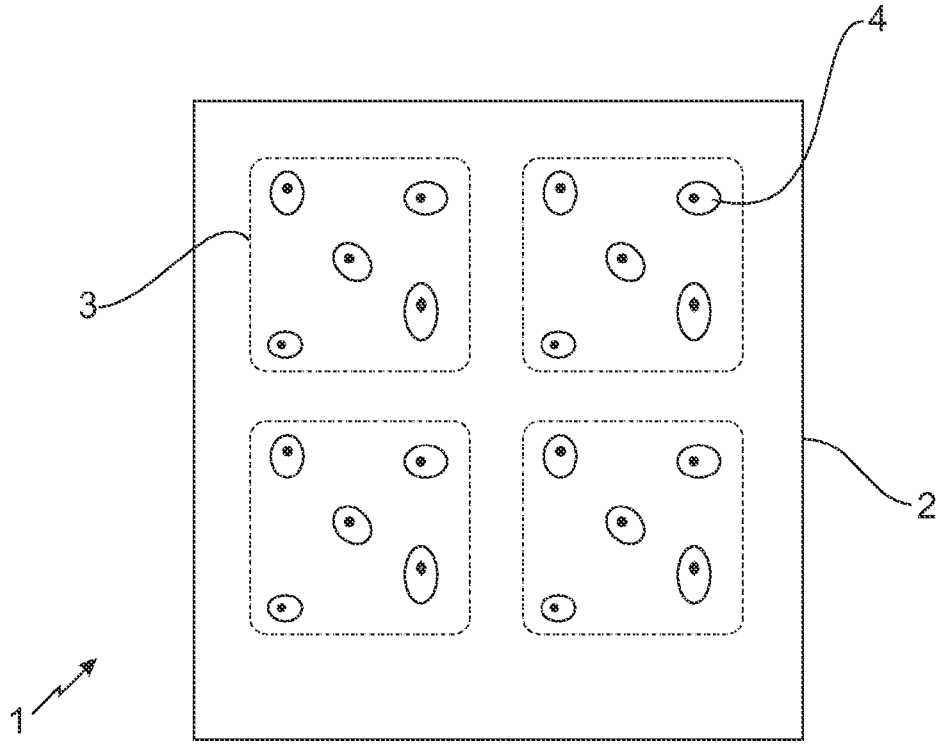
FIG. 3 is a front view of a climbing wall provided with a plurality of devices for managing the illumination according to the invention.

In reference to FIG. 3, an emission loop 3 can be advantageously associated with several reception loops and therefore with several grips 4 in order to simultaneously supply several light sources 7. This configuration allows for substantial modularity of the wall 2 thanks to the variability of the position of the grips 4.

Figure 4:
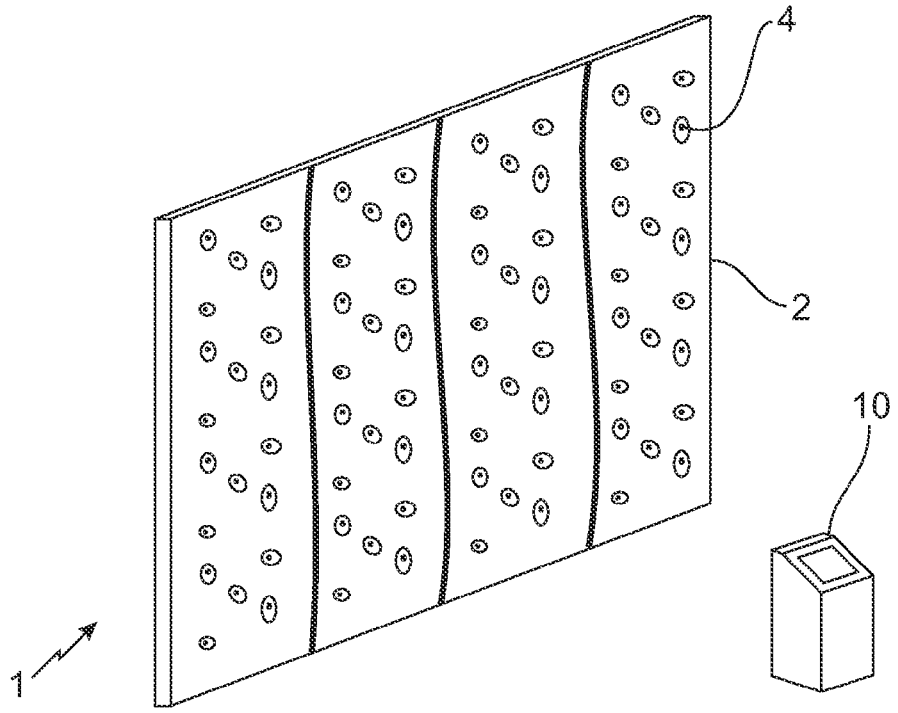
FIG. 4 is a perspective view of a climbing wall provided with a plurality of devices for managing the illumination and with a software interface terminal.
Figure 5:
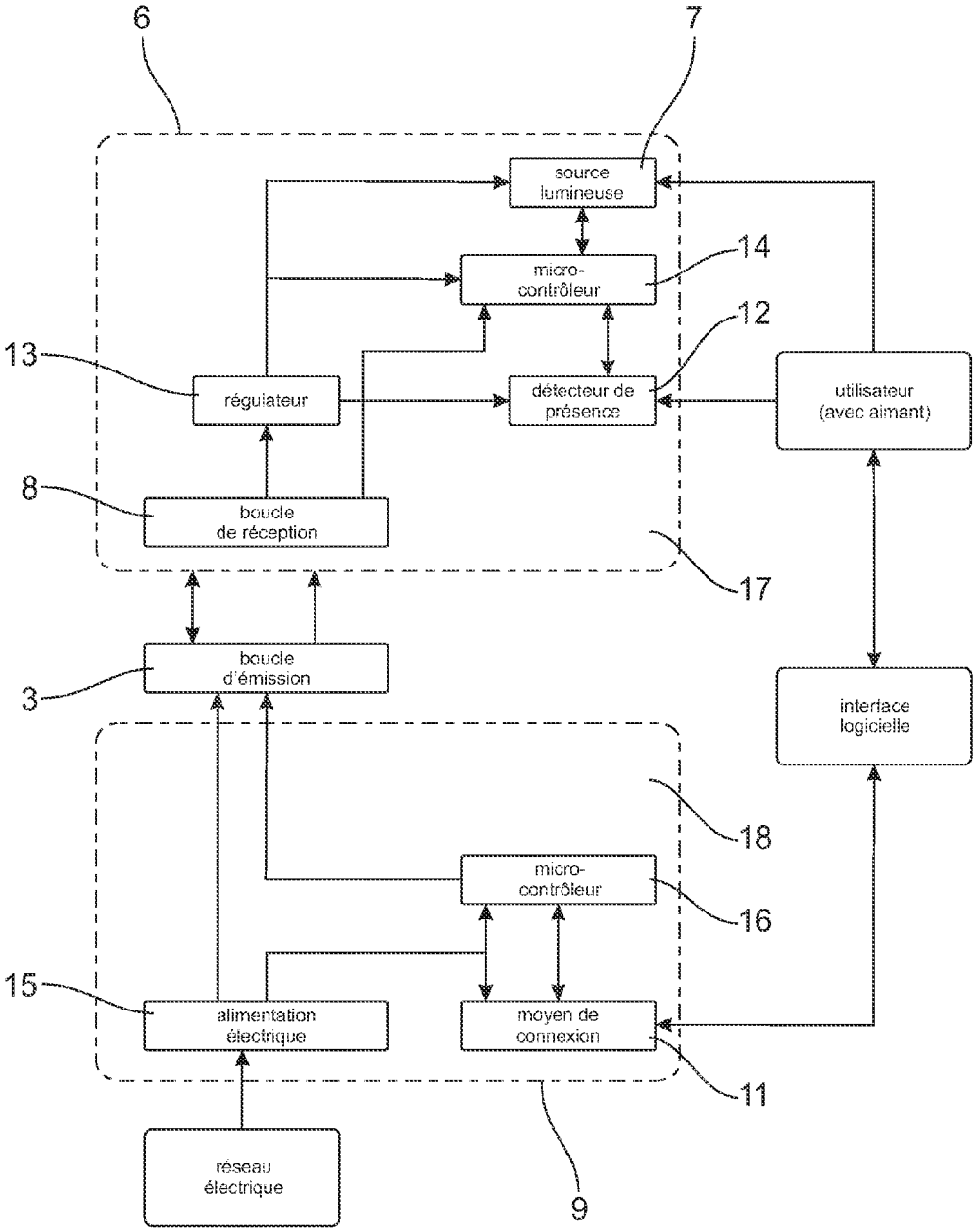
FIG. 5 is a diagram of a first operating principle associated with a first alternative of the device for managing the illumination of a climbing wall according to the invention.
Figure 6:
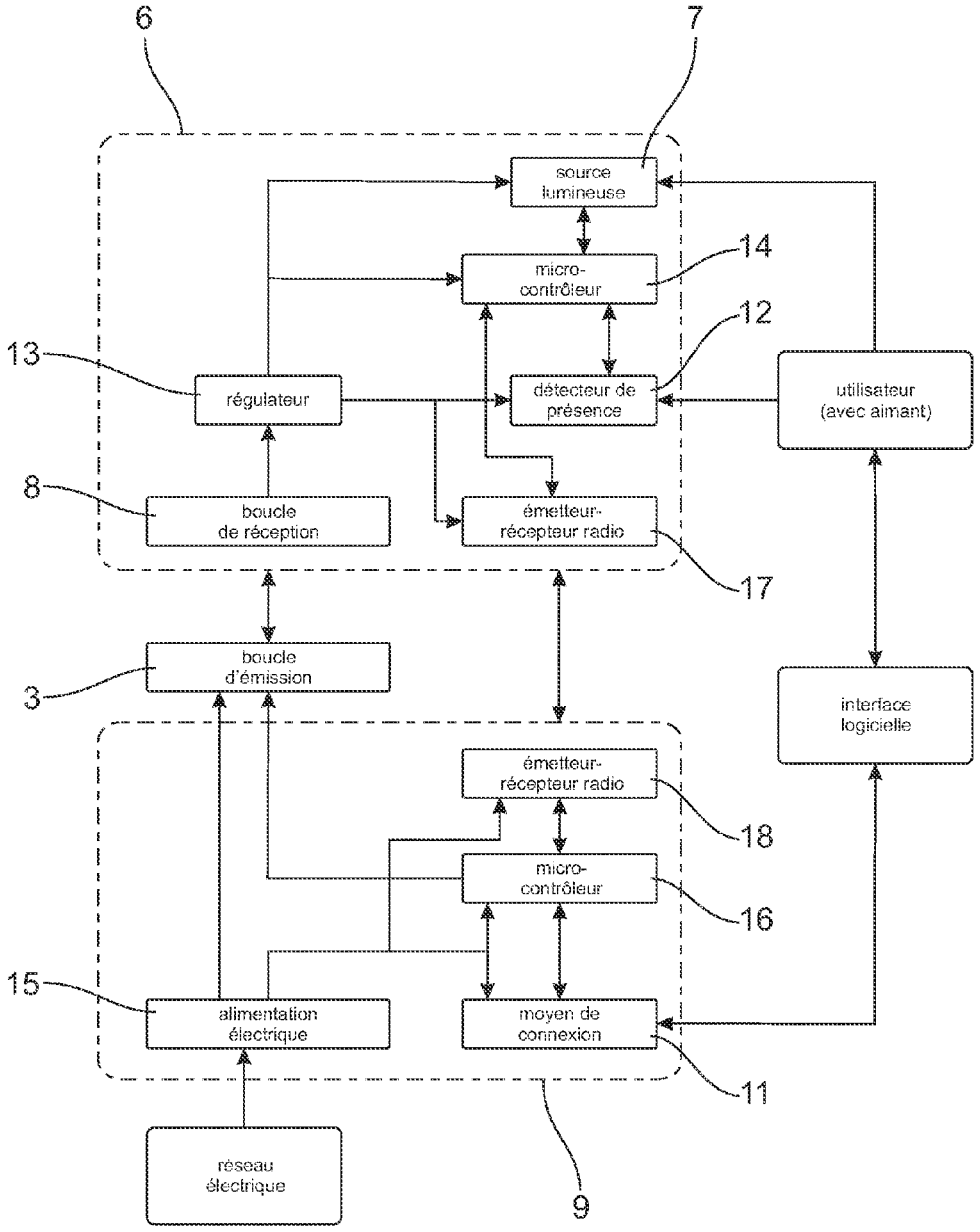
FIG. 6 is a diagram of a second operating principle associated with a second alternative of the device for managing the illumination of a climbing wall according to the invention.

In reference to FIGS. 4 to 6, the device for managing 1 also comprises a control housing 9 able to activate the emission loops 3 in order to light or not light the light sources 7 of the grips 4 and a software interface that operates more preferably using an interactive terminal 10 making it possible to manage the illumination of one or several paths.

However, the software interface can also be used on other hardware platforms with for example restrictions in functionalities according to the users.

As such, a version of the software interface for portable telephones, of the Smartphone type, will allow a forerunner to install the grips alone in order to create new paths.

Likewise, a Smartphone/PC/interactive terminal version will make it possible to visualise and to choose paths, and to safeguard various parameters that are proper to the climbers.

A PC (Personal Computer) version will be primarily dedicated to the computer of the manager of the climbing room provided with the device for managing 1 according to the invention.

Finally, the software interface can be used for "announcement" screens arranged in various locations in the room in order to communicate on the technical capacities and functionalities of the device for managing 1 and to present information on the other paths available in the room.

In order to ensure the compatibility between the various platforms, the software interface is more preferably carried out in the form of a web server built into said control housing 9 of the light sources 7, said control housing comprising a means for connecting 11 allowing the terminal 10 to be connected to the software interface built into said housing via a wireless protocol, of the "WIFI" type for example, or via cables of the "ETHERNET" type for example.

The software interface of the device for managing 1 makes it possible to graphically scroll the paths and the walls and, if the wall retained is not being used, to illuminate the chosen programmed paths on the wall concerned. Choosing a path actuates the illumination of the light sources 7 concerned and advantageously inaccessibility for all of the other paths that use light sources 7 that are part of the chosen path.

The software interface advantageously makes it possible to time and record the time taken by a climber in carrying out the chosen path. This latter functionality requires installing a presence detector 12 of the climber on the electronic card 6 of the device for managing 1. The detecting of the climber is advantageously of the magnetic type and can be associated with a bracelet that comprises a magnet worn by the climber, said magnet modifying the magnetic field in the vicinity of the grip and making it possible to detect the presence of the climber. This detector is preferably a switch of the reed switch type (ILS or REED switch) for its lifespan and its reliability.

This functionality in addition requires setting up a bidirectional link between the grip or grips 4 and the control housing 9 of the light sources 7. This bidirectional link advantageously uses radiofrequencies.

In reference to FIG. 5, the electronic card 6 also comprises a regulator 13 and a microcontroller 14 making possible in particular the management of the identification information of the light source 7 and of the associated grip 4. Indeed, during the installation of new grips 4 on the climbing wall 2 and/or during the recording of new paths, the forerunner makes it possible thanks to the presence detector 12 to attribute a unique identifier to each grip 4 of the recorded path, said unique identifier making it possible to light the light source 7 only according to need, the chosen path and orders from the control housing 9.

Likewise, in reference to FIG. 5, the control housing 9, which is connected to at least one emission loop 3, also comprises an electrical power supply 15 in order to supply said emission loop 3 with electric current and a microcontroller 16 making it possible to control the proper operation of the device for managing 1.

However, in reference to FIG. 6, in order to allow for the timing of the course, the electronic card 6 of the grip 4 and the control housing 9 each also comprise a transceiver, preferably of the radiofrequency type, respectively 17, 18. As such, when the climber is detected on the grip 4, the latter sends his unique identifier to the control housing 9, thanks to their respective transceivers 17, 18.

Finally, in reference to FIGS. 5 and 6 and with such a configuration, the device for managing 1 can operate according to at least two principles.

As such, the first operating principle, shown diagrammatically in FIG. 5, provides three operating modes: the installation mode, the usage mode and the path programming mode.

When the device for managing 1 is in installation mode, the emission loops 3 are activated and the control housing 9 sends an order indicating to any grip 4 that enters into activity (turned on) and that detects a climber to store a unique identifier contained in the order, said unique identifier then being used to respond only to orders specific to said unique identifier and sent by the control housing 9. The grip is then initialised and activated with an identifier and the forerunner can move on to the following grip 4, and so on.

When the device for managing 1 is in usage mode, the control housing 9 of the light sources 7 activates the emission loops 3 and the light sources 7 receive orders by demodulation of the signal received by the reception loop 8. If the order is a broadcast command or contains their identifier then the light sources 7 execute the order and are lit, otherwise, the light sources 7 remain off in standby mode, corresponding to low power consumption.

When the device for managing 1 is in path programming mode that allows a forerunner to create new paths, the software interface makes it possible to send a "broadcast" command to all of the light sources 7 so that they are ready to receive and to memorise the identifier of the path during programming, if the presence detector 12 is activated by the forerunner. When the forerunner approaches his bracelet comprising a magnet for more than three seconds, it is detected, the grip 4 becomes active for the path being programmed and then memorises the path identifier, contained in the "broadcast" command, in its memory of identifiers for which it has to execute an action. In order to signal that it has indeed taken his selection into account, the grip 4 could take on a defined colour. As long as the path programming mode is active, the forerunner can select and deselect a grip by "activating" or not its presence sensor. At the end of path programming, the software interface sends a path programming end "broadcast" command in order to place the grips 4 in usage mode. Each grip 4 now knows whether or not it has to carry out an order concerning the programmed path in question, by searching in its memory for the path identifier associated with said order that it receives. As such, if the path identifier is present it then carries out the action requested, otherwise it does nothing.

Finally, the second operating principle, shown diagrammatically in FIG. 6, provides four operating modes: the installation mode, the usage mode, the path programming mode and the timing mode. The three first operating modes are identical to those described hereinabove.

However, when the device for managing 1 is in timing mode (the only mode that must have a bidirectional link), more preferably of the radiofrequency type, when the climber is detected by the bracelet or the presence of the climber, the grip 4 sends the identifier and the presence information to the control housing 9 of the light sources 7, via radiofrequency link, thanks to their respective transceivers 17, 18. This bidirectional link makes it possible in particular to determine the time between each grip 4 and the total duration of the path.

However, wherein the setting up of a bidirectional link of the radiofrequency type would significantly increase the price of a grip 4 and therefore of the device for managing 1, only the grips 4 that can be located in the first position of a course and in the last position of the path will be provided with the bidirectional link, allowing as such for the timing of said path. To do this, the first and last grip of the path concerned must be identified in the device for managing 1.

DESCRIPTION OF OTHER EMBODIMENTS

According to an alternative embodiment not shown, the device for managing the illumination of an artificial climbing wall according to the invention is associated, thanks to a bidirectional link of the radiofrequency type, with a marker or identification tag (RFID tag) worn by each climber, said tag having more preferably the form of a bracelet.

Indeed, the emission loop has the ability to communicate bidirectionally with the electronic card of each grip comprising at least one reception loop but also with RFID tags and other RFID sensors.

This association allows for automatic identification of the climber by the emission loop and the control housing of the light sources.

The operating principles of the device for managing the illumination and of the software interface are not called into question in their basic operating modes, however the use of said device for managing is simplified as passage through the software interface is no longer required.

Indeed, forerunners can validate the adding of a grip to an itinerary thanks to the identification tag of the bracelet without having to connect with the software interface.

Likewise, users can choose to not pass through the software interface and directly access an itinerary by approaching their identification tag to a grip. The itineraries to which said grip belongs are then automatically and successively proposed to him.

Furthermore, every user will have his statistics updated automatically, as soon as he is recognised on an itinerary.

When several are practicing, this provides flexibility in use by automatically generating the updating of the profiles without returning to the interactive terminal.

POSSIBILITY FOR INDUSTRIAL APPLICATION

The device for managing 1 the illumination according to the invention applies more particularly to the marking of paths on artificial climbing walls, but it can also be used to provide for the decoration/animation of the climbing room through the use of illumination sequences carried out for this purpose.

Finally, it goes without saying that the examples of device for managing 1 the illumination in accordance with the invention that have just been described are only particular illustrations, and in no way limit the invention.

The invention claimed is:

1. An illumination management device intended for an artificial climbing wall comprising at least one emission loop arranged so as to be fixed to the rear of the wall and being able to emit an electromagnetic field through said wall, at least one luminous grip arranged so as to be fixed to the front of said wall and able to receive an electronic card comprising at least one light source and a reception loop able to receive said electromagnetic field emitted by the associated emission loop so as to convert it into electric current in order to power said light source, and a control housing for the light source being arranged so as to be connected to an electrical network so as to power said emission loop with electric current and able to send commands to manage the illumination of said light source.

2. The device according to claim 1, wherein the electronic card further comprises a presence detector of a climber on the associated grip.

3. The device according to claim 2, wherein the presence detector is a reed switch associated with a magnet or an RFID reader associated with a tag, the magnet or the tag having the form of a bracelet arranged to be worn by a climber.

4. The device according to claim 1, wherein the electronic card further comprises a regulator and a microcontroller making possible in particular the management of the identification information of the light source and of the associated grip.

5. The device according to claim 1, wherein the electronic card is embedded in the material of the grip.

6. The device according to claim 1, wherein the electronic card is embedded in the material of an independent removable subset able to be inserted into the back of the grip.

7. The device according to claim 5, wherein the grip or the subset further comprises a portion made of flexible material wherein the electronic card is embedded.

8. The device according to claim 1, characterised in that the control housing further comprises an electrical power supply to supply said emission loop with electric current and a microcontroller making it possible to control the proper operation of the illumination device.

9. The device according to claim 1, further comprising:
a multi-platform software interface.

10. The device according to claim 9, wherein the software interface is carried out in the form of a web server built into said control housing for light sources.

11. The device according to claim 10, further comprising:
at least one interactive terminal making it possible to manage the illumination of one or several paths and in that the control housing comprises a means of connection allowing the terminal to be connected to the software interface built into said housing via a wireless protocol or via cables.

12. The device according to claim 1, further comprising:
a bidirectional link between the grip or grips and the control housing of the light sources making it possible to measure and record the time taken by a climber to carry out the chosen path.

13. The device according to claim 12, wherein the bidirectional link uses radio frequencies and in that the electronic card of the grip and the control housing of the light sources each comprise a transceiver, respectively.

* * * * *